US005295590A

United States Patent [19]

Feer

[11] Patent Number: 5,295,590

[45] Date of Patent: Mar. 22, 1994

[54] NAPKIN HOLDER

[75] Inventor: David L. Feer, Medina, Ohio

[73] Assignee: Rubbermaid Incorporated, Wooster, Ohio

[21] Appl. No.: 996,778

[22] Filed: Dec. 23, 1992

[51] Int. Cl.[5] ..... A47F 7/00

[52] U.S. Cl. ..... 211/50

[58] Field of Search ..... 211/50; D7/631, 632, D7/634, 590

[56] References Cited

U.S. PATENT DOCUMENTS

| | | | |
|---|---|---|---|
| D. 268,119 | 3/1983 | Evenson | D19/77 |
| D. 290,077 | 6/1987 | Hansen | D7/631 |
| D. 299,478 | 1/1989 | Keodt | D19/90 |
| D. 306,040 | 2/1990 | Evenson | D19/90 |
| D. 306,041 | 2/1990 | Evenson | D19/90 |
| D. 307,159 | 4/1990 | Foran | D19/90 |
| D. 313,430 | 1/1991 | Evenson | D19/90 |
| D. 323,190 | 1/1992 | Evenson | D19/90 |
| 714,137 | 11/1902 | Branch | 211/50 |
| 812,634 | 2/1906 | Brown | 211/50 |
| 2,248,396 | 7/1941 | Terry | 271/18 |
| 2,940,598 | 6/1960 | Sundberg | D7/631 X |
| 3,365,067 | 1/1968 | Miller et al. | 211/45 |
| 3,767,057 | 10/1973 | Holmes | 211/10 |
| 4,609,112 | 9/1986 | Belanger | 211/45 |
| 4,874,099 | 10/1989 | Arnott et al. | 211/50 |
| 5,201,428 | 4/1993 | Pasinski et al. | 211/50 |

OTHER PUBLICATIONS

Price List, Napkin Holders; Spectrum Diversified Designs Inc., P.O. Box 901133, Cleveland, Ohio 44190, Publication date Jan. 1, 1991.

Pp. 10 and 11, Napkin Holders; Arrow Plastic Manufacturing Co. 701 E. Devon Ave., Elk Grove, IL 60007. Publication date Dec. 3, 1990.

P. 21, Napkin Holders, Alladin Plastics, Inc., 703 Murfreesboro Rd., Nashville, TN 37210. It is believed that the product depicted herein has been on sale for more than one (1) year prior to the application date of this instant application.

Sell Sheet, Napkin Holder, Sterilite Corporation, P.O. Box 524, Main St., Townsend, MA 01469. It is believed that the product depicted herein has been on sale for more than one (1) year prior to the application date of this instant application.

P. 28, Napkin Holder, Tucker Housewares, 25 Tucker Dr., Leominster, MA 01469. It is believed that the product depicted herein has been on sale for more than one (1) year prior to the application date of this instant application.

P. 43, Racks, Eldon Industries, 1130 E. 230th St., Carson, CA 90745. Publication date 1989.

P. 25, Napkin Holder, Rubbermaid Incorporated, Office Products Division, Lincoln Way West, Wooster, Ohio 44691. Publication date 1990.

*Primary Examiner*—Robert W. Gibson, Jr.

*Attorney, Agent, or Firm*—Richard E. O'Planick; Lisa B. Riedesel

[57] ABSTRACT

A napkin holder is disclosed comprising a freestanding base (4) and spaced apart vertical wall members (6,8) which define a channel (18) therebetween for receipt of a vertical stack of napkins. The wall members comprise intersecting first and second panels (10,12 and 14,16) which form an obtuse angle such that the stack of napkins in the channel form an obtuse angle and remain in an upright condition.

10 Claims, 5 Drawing Sheets

NAPKIN HOLDER

BACKGROUND OF THE INVENTION

1. Field of the Invention

The subject invention relates generally to devices intended to hold a vertical stack of sheet stock in an upright condition, and more particularly to devices such as napkin holders.

2. The Prior Art

Devices such as napkin holders are well known commercial products. Typical holders comprise a base from which spaced apart vertical walls extend upward. The walls define a channel therebetween, open at opposite ends and terminating at a bottom floor, for receiving a vertical stack of napkins. The walls are spaced apart a distance sufficient to create a channel wide enough to receive a vertical stack of napkins, approximately one to two inches in depth.

While the above-described existing napkin holders work well, certain shortcomings exist therein. First, while the holder channel is wide enough to receive a sufficient number of napkins initially, and adequately functions to maintain the napkins vertical, after withdrawal of a number of napkins the stack tends to double over. This is because, as napkins are withdrawn, the stack diminishes in depth to substantially less than the one to two inch width of the channel. The napkin stack thereupon slides downward along the bottom floor until its bottom edge contacts the bottom edge of an opposite vertical wall. The weight of the stack presses the stack against the bottom channel floor and the stack assumes a C-shape which makes it more difficult to withdraw the next napkin.

Secondly, if the vertical holder walls are less than half the height of the napkin stack, the stack will tend to hang over the top of one of the vertical walls, making it relatively more difficult to grasp and withdraw one of the end napkins.

Other known napkin holders incorporate a mechanism such as a pressure plate for pressuring the stack of napkins against one of the vertical walls. Such holders are, however, substantially more expensive, require assembly, and are more difficult for the end user to use.

SUMMARY OF THE INVENTION

The present invention eliminates the above deficiencies in the state of the art napkin holders by providing a holder having sidewalls and a bottom floor shaped to define an obtuse angled channel. The vertical stack of napkins positioned within the channel assumes a corresponding obtuse angled shape, and the bend tends to keep the stack in an upright position.

The ends of one vertical wall lie in a common vertical plane extending through the channel, with a median portion of the vertical plane lying in close proximity to the inward bend of the opposite vertical wall. As the napkin stack dwindles to a shallow depth, the napkins remaining in the stack slide only a small distance before contacting the bend portion of the opposite sidewall. Supported by the ends of the first vertical wall and abutting the bend in the opposite vertical wall, the stack remains vertical even until only a single napkin remains in the stack.

Accordingly, it is an objective to provide a napkin holder having improved means for preventing a vertical stack of napkins from doubling over.

It is a further objective to provide a napkin holder having means for maintaining a stack of napkins in a vertical orientation and keeping the remaining napkins so oriented after napkins are withdrawn from the stack.

Still a further objective is to provide a napkin holder of unitary construction suitable for manufacture from plastic material by conventional manufacturing methods.

Yet a further objective is to provide a napkin holder of unitary construction having no moveable parts and requiring no assembly.

A further objective is to provide a napkin holder which is economical to manufacture and easy to use.

These, and other objectives, which will be apparent to one skilled in the art, are achieved by a preferred embodiment which is described in detail below and which is illustrated by the accompanying drawings.

BRIEF DESCRIPTION OF THE ACCOMPANYING DRAWINGS

DETAILED DESCRIPTION OF THE PREFERRED EMBODIMENT

Figure 1:
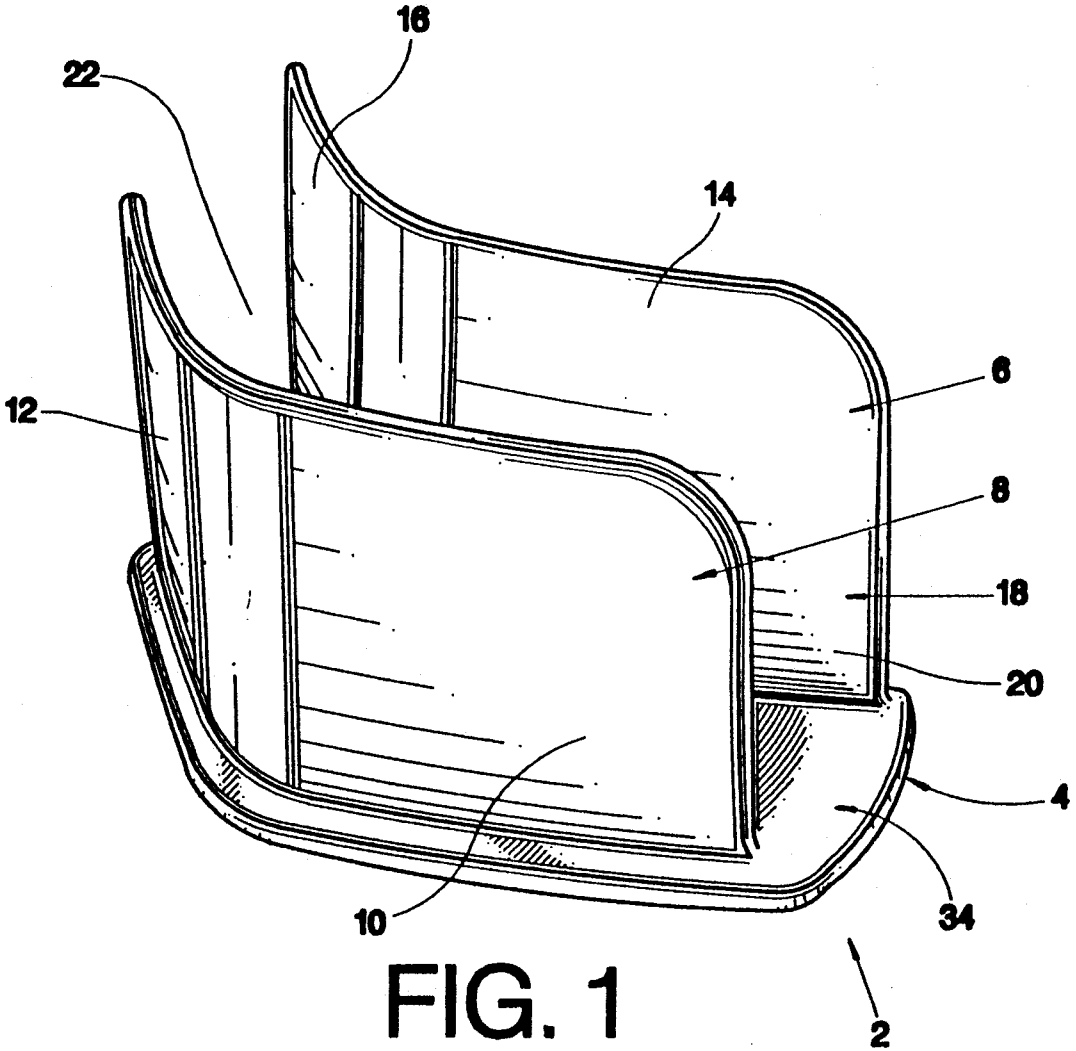
FIG. 1 is a front perspective view of the subject napkin holder.

Referring initially to FIG. 1, the subject napkin holder 2 is illustrated to be of unitary construction, suitable for manufacture from conventional grade plastics material by an injection molding process. The holder comprises a base 4 from which spaced apart vertical wall members 6,8 extend. The wall member 8 is formed by intersecting wall panels 10, 12, while the wall member 6 is formed by intersecting wall panels 14,16. The wall members thus are configured to form an obtuse angle, with panels 10, 12 of wall member 8 extending parallel to corresponding panels 14,16 of wall member 6.

The wall members 6,8 define an obtuse angle-shaped channel 18 therebetween which is comprised of communicative channel portions 20 and 22. The channel is open at opposite ends thereof and along a top side for the purpose of receiving a vertical stack of napkins (not shown).

Figure 2:
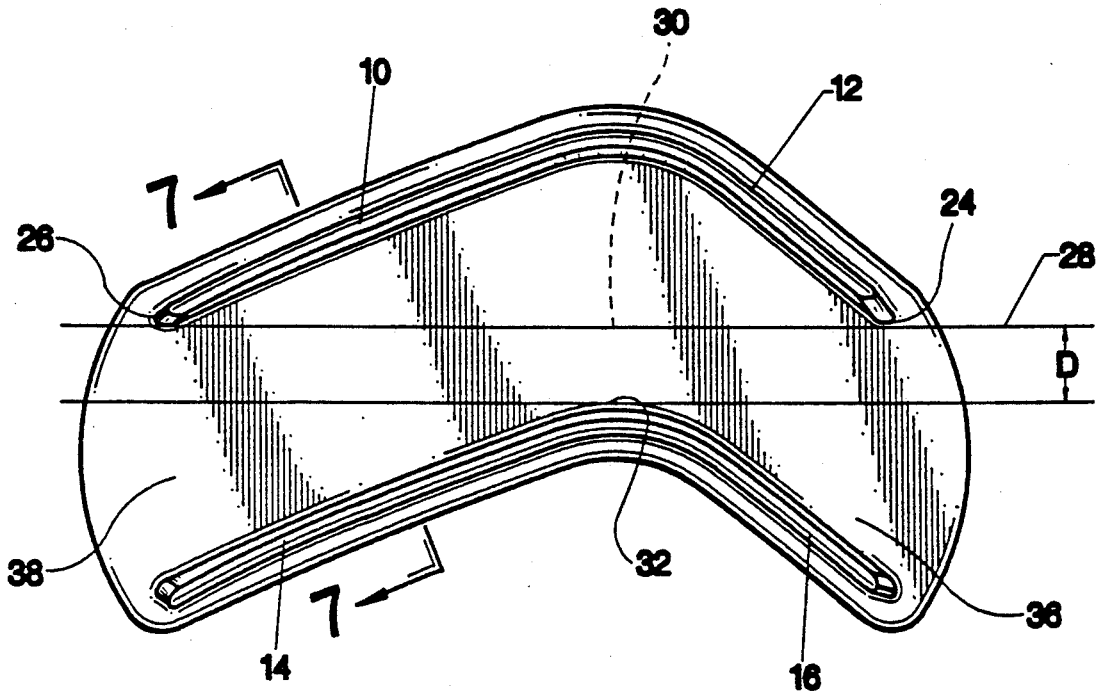
FIG. 2 is a top plan view thereof.
Figure 3:
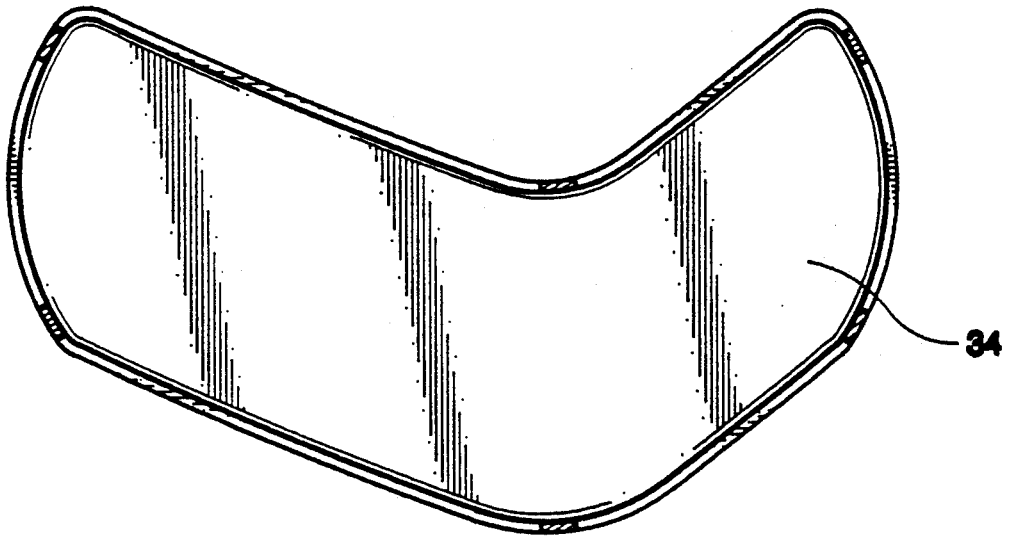
FIG. 3 is a bottom plan view thereof.
Figure 4:
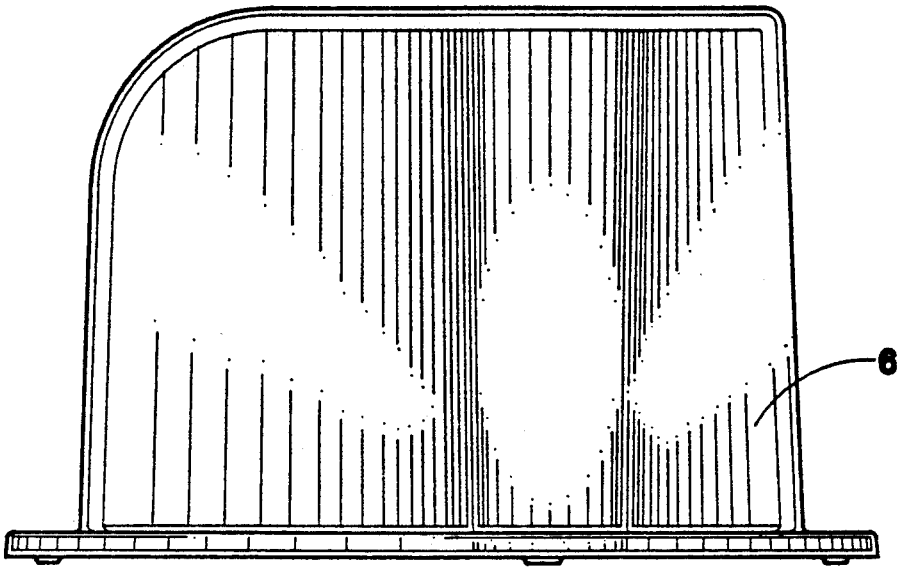
FIG. 4 is a front elevation view thereof.
Figure 5:
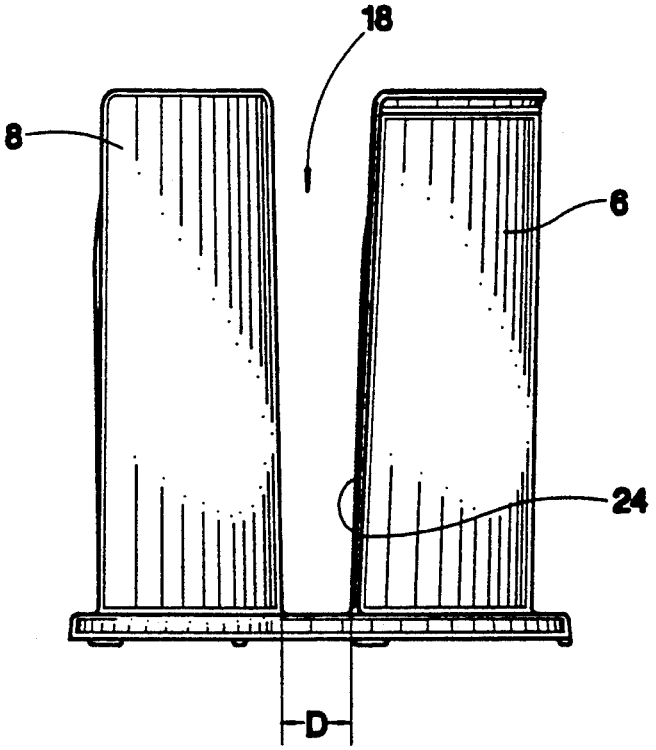
FIG. 5 is an end elevation view thereof.
Figure 6:
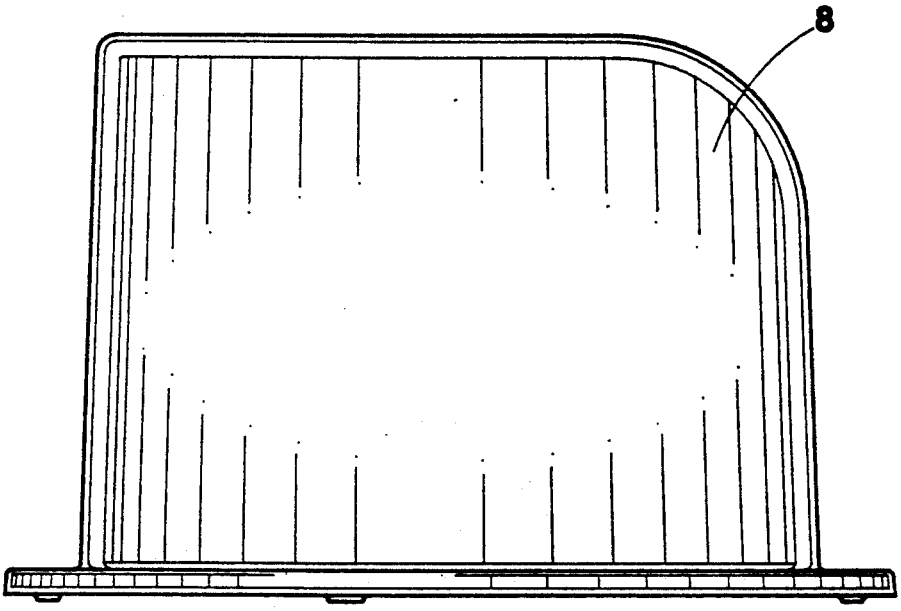
FIG. 6 is a rear elevation view thereof.

Continuing, with reference to FIGS. 1 and 2, the wall member 8 has opposite ends 24, 26 which lie in a common vertical plane, indicated diagrammatically at 28. The vertical plane 28 extends through the channel 18 as shown, with a median portion 30 of plane 28 located in spatial proximity to an inward bend 32 of wall member 6 formed by intersecting wall panels 14, 16. The median portion 30 is spaced a distance "D" of five hundred fifty thousandths of an inch from the bend 32 as shown, for a purpose explained further below.

Dimensionally, in the preferred embodiment the wall panels 10, 14 are approximately four inches in length, and wall panels 12, 16 two and three-quarters inches in length for aesthetic purposes, although the panels can be longer, shorter, or equivalent in length if so desired. The above dimensions create a channel 18 having a length substantially equal to a standard dinner napkin. The height of the wall members 6,8 is approximately also equal to the height of a paper dinner napkin. The spacing between the wall panels 10, 14 and panels 12,16 is approximately one and three-quarters inches, as designated by "X" in FIG. 7, whereby accommodating the receipt of a vertical stack of napkins of like depth therebetween.

The channel 18 terminates at a bottom floor 34, comprising intersecting floor segments 36, 38. The floor 34 accordingly assumes an obtuse angle shape and is adapted to supportively engage the lower edge of the stack of napkins within the channel 18. The stack of napkins, when positioned within the channel, rest upon the floor 34 and assume the obtuse bend created by wall members 6, 8.

Figure 7:
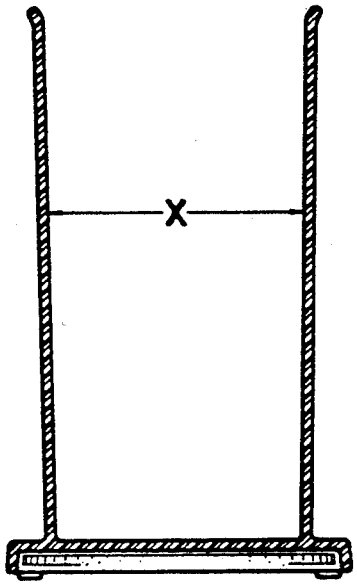
FIG. 7 is a transverse section view thereof taken along the line 7—7 of FIG. 2.

Referring to FIGS. 1, 2 and 7, it will be appreciated that the subject napkin holder functions as follows. A stack of vertically oriented napkins, having a depth of approximately one and three-quarters inches, may be inserted into the channel 38, whereupon assuming the obtuse angle shape of the channel. So positioned and having the aforementioned bend, the stack will tend to remain in a vertical orientation and not droop or double over.

Withdrawal of the napkins is made from either end of the stack by the user in conventional manner. As the stack depth diminishes, the lower edge of the stack will migrate along the floor 34 until engaging the bend portion 32, representing the intersection of panels 14, 16. Alternatively, if the residual stack is in contact with the bend portion 32, the top of the stack will tip over until the top of the stack engages ends 24,26 of the wall member 8. Because of the angular shape of the channel, the distance traveled by the lower edge of the stack or the upper edge of the stack can be at most a distance of five hundred fifty thousands of an inch. The stack height is approximately six inches. The three point contact of the stack with the bend portion 32, and wall member ends 24,26 is sufficient to keep the stack in its intended vertical orientation.

Since the distance which the stack upper or lower edges may travel is so small relative to the height of the stack, the weight of the napkins is maintained relatively centered over the bottom edge of the stack and does not cause the stack to double over. Were the wall members 6, 8 planar and parallel plates, spaced apart one and three quarters inches as in conventional napkin holders, the distance traveled by the lower edge of the stack would be one and three-quarters inches. The weight of the stack would be sufficient to cause the stack to double over and bend along the floor of the channel and up the wall member. The consequent orientation of the napkins would make additional withdrawal of a single napkin cumbersome.

Thus, the subject invention provides a holder which can accommodate a thick stack of napkins yet, as the stack is reduced, eventually to a single napkin, maintain the stack in a relatively vertical orientation, supported by three point contact with the bend 32 and the wall member ends 24, 26. Even when one napkin is left, as shown diametrically by plane 28 in FIG. 2, the napkin can only bend five hundred and fifty thousands of an inch before contacting the bend 32. It will be appreciated that, similarly, a single napkin positioned against bend 32 will travel the same distance before contacting the ends 24,26 of the opposite wall member.

While the above describes the preferred embodiment, the subject invention is not to be so restricted. Other embodiments which utilize the teachings hereof are intended to be within the scope and spirit of the subject invention. For example, the wall member panels may be equal in length. Moreover, the distance "D" in FIG. 2 may be increased or decreased by moving the wall members away or toward each other. Distance "D" may be reduced to equate with the width of a single napkin, if so desired. In such a configuration, the napkin would be maintained substantially vertical by the aforementioned three point contact.

Further, the bend 32 shown in FIG. 2 may be replaced by a sharp edge if so desired. In addition, other applications of the subject invention which will be apparent to those skilled in art are also intended to be within the scope of this disclosure. The present invention may find utility any where it is desirable to maintain sheet stock, not necessarily napkins, in a vertical stack for individual withdrawal.

I claim:

1. A napkin holder, of the type comprising a free-standing base and spaced apart, generally vertical opposed wall members extending upward from the base and defining a channel therebetween for receipt of a vertical stack of napkins, the improvement comprising:

each of the wall members comprising intersecting first and second wall panels and the channel having channel portions which intersect to form an obtuse angle defined by the wall panels;

one of the wall members having opposite ends which lie in a vertical plane extending through said channel, with a median portion of the vertical plane being spaced apart a lateral distance from the intersection of the first and second wall panels of the opposite said wall member; and a vertical sided channel portion, open at opposite ends and with a width equivalent to said lateral distance extends between said opposite ends of the one wall member.

2. A napkin holder according to claim 1, wherein the channel having open opposite ends.

3. A napkin holder according to claim 2, wherein the channel terminating at a bottom floor.

4. A napkin holder according to claim 3, wherein the floor comprising floor portions which intersect to form an obtuse angle and which support edges of said vertical stack of napkins.

5. A napkin according to claim 1, wherein the channel having open opposite ends and the channel terminating at a bottom floor, said bottom floor having floor portions which intersect to form an obtuse angle and which support edges of said vertical stack of napkins.

6. A napkin holder according to claim 5, wherein each of the vertical wall members comprising first and second panels which intersect at an obtuse angle and which extend parallel to corresponding first and second panels of the opposite said wall member.

7. A napkin holder according to claim 6, wherein outward ends of the first and second panels of one wall member lie in a vertical plane extending through the channel, and a median portion of the vertical plane lies in close proximity to the intersection of the first and second panels of the opposite wall member.

8. A napkin holder according to claim 7, wherein the first and second panel intersection is outwardly radiused.

9. A napkin holder according to claim 8, wherein the channel floor is smooth surfaces, whereby a bottom edge of a vertically oriented napkin placed between the vertical wall members will move along the floor until the napkin is supported by said outward ends of the first and second panels of the one wall member and intersecting portions of the first and second panels of the opposite wall member.

10. A napkin holder according to claim 9, wherein the maximum distance said vertically oriented napkin will travel is equidistant to the spacing between the vertical plane median portion and the intersection of the first and second panels of said opposite wall member.

* * * * *